US011255499B1

(12) United States Patent
Xi

(10) Patent No.: US 11,255,499 B1
(45) Date of Patent: Feb. 22, 2022

(54) ROTATALBE ELECTRICAL CONNECTOR AND NIGHT LIGHT USING THE SAME

(71) Applicant: Guangdong YUHAO Electronics Co., Ltd., Dongguan (CN)

(72) Inventor: Jun Xi, Dongguan (CN)

(73) Assignee: GUANGDONG YUHAO ELECTRONICS CO., LTD., Dongguan (CN)

( * ) Notice: Subject to any disclaimer, the term of this patent is extended or adjusted under 35 U.S.C. 154(b) by 0 days.

(21) Appl. No.: 17/108,320

(22) Filed: Dec. 1, 2020

(30) Foreign Application Priority Data

Sep. 23, 2020 (CN) ..... 202022096385.X

(51) Int. Cl.

| | |
|---|---|
| ***F21S 8/00*** | (2006.01) |
| ***H01R 24/68*** | (2011.01) |
| ***H01R 35/04*** | (2006.01) |
| ***F21V 33/00*** | (2006.01) |

(52) U.S. Cl.
CPC ..... *F21S 8/035* (2013.01); *F21V 33/0004* (2013.01); *H01R 24/68* (2013.01); *H01R 35/04* (2013.01)

(58) Field of Classification Search
CPC ..... F21S 8/035; H01R 24/68; H01R 35/04; F21V 33/0004
See application file for complete search history.

(56) References Cited

U.S. PATENT DOCUMENTS 8,147,097 B1 4/2012 Hsiao
9,958,121 B2 5/2018 Wu

*Primary Examiner* — Thomas M Sember
(74) *Attorney, Agent, or Firm* — Hemisphere Law, PLLC; Zhigang Ma

(57) ABSTRACT

A night light includes a fixed part, a rotatable part and a shaft connecting the rotatable part and the fixed part and allowing the rotatable part to rotate relative to the fixed part. The fixed part includes two pins configured for electrically connecting with an external power socket, and two elastic elements fixed to top ends of the two pins, respectively. The rotatable part includes two concentric annular conductive members exposed at a lower end of the rotatable part. The two elastic elements provide upward elastic support to the two concentric annular conductive members, respectively, such that the elastic elements can constantly contact and press the two concentric annular conductive members when the rotatable part rotates relative to the fixed part.

14 Claims, 5 Drawing Sheets

ROTATALBE ELECTRICAL CONNECTOR AND NIGHT LIGHT USING THE SAME

CROSS-REFERENCE TO RELATED APPLICATION

This application claims priority benefit of Chinese Application 202022096385.X, filed on Sep. 23, 2020, said application being fully incorporated by reference herein.

BACKGROUND OF THE INVENTION

1. Technical Field

The present invention relates electrical connectors, in particular to a rotatable electrical connector and a night light using the rotatable electrical connector.

2. Description of Related Art

Most household appliances, such as night lights have an electrical connector for connecting to a wall socket. The electrical connectors may be roratable or un-rotatable. Rotatable electrical connector allows angular position adjustment and thus more convenience. HSIAO MING JEN, U.S. Pat. No. 8,147,097 discloses an angle-adjustable aroma-diffusing night lamp system includes a electrical plug unit A, a lamp socket unit B, and a collar C. When rotating the electrical plug unit A relative to the lamp socket unit B and the collar C to a desired angle, a center contact 22 and a ring contact 21 respectively keep in positive contact with a positive contact blade 23 and a negative contact blade 19, thus an electrical power supply can be maintained. However, the center contact and the ring contact may deform after long time use, resulting in poor contact between the center contact/the ring and the positive contact blade/the negative contact blade. Furthermore, the structure of the angle-adjustable aroma-diffusing night lamp system is complicated and not easy to assemble.

BRIEF DESCRIPTION OF THE SEVERAL VIEWS OF THE DRAWINGS

The foregoing and other exemplary purposes, aspects and advantages of the present invention will be better understood in principle from the following detailed description of one or more exemplary embodiments of the invention with reference to the drawings, in which.

DETAILED DESCRIPTION OF THE INVENTION

Figure 1:
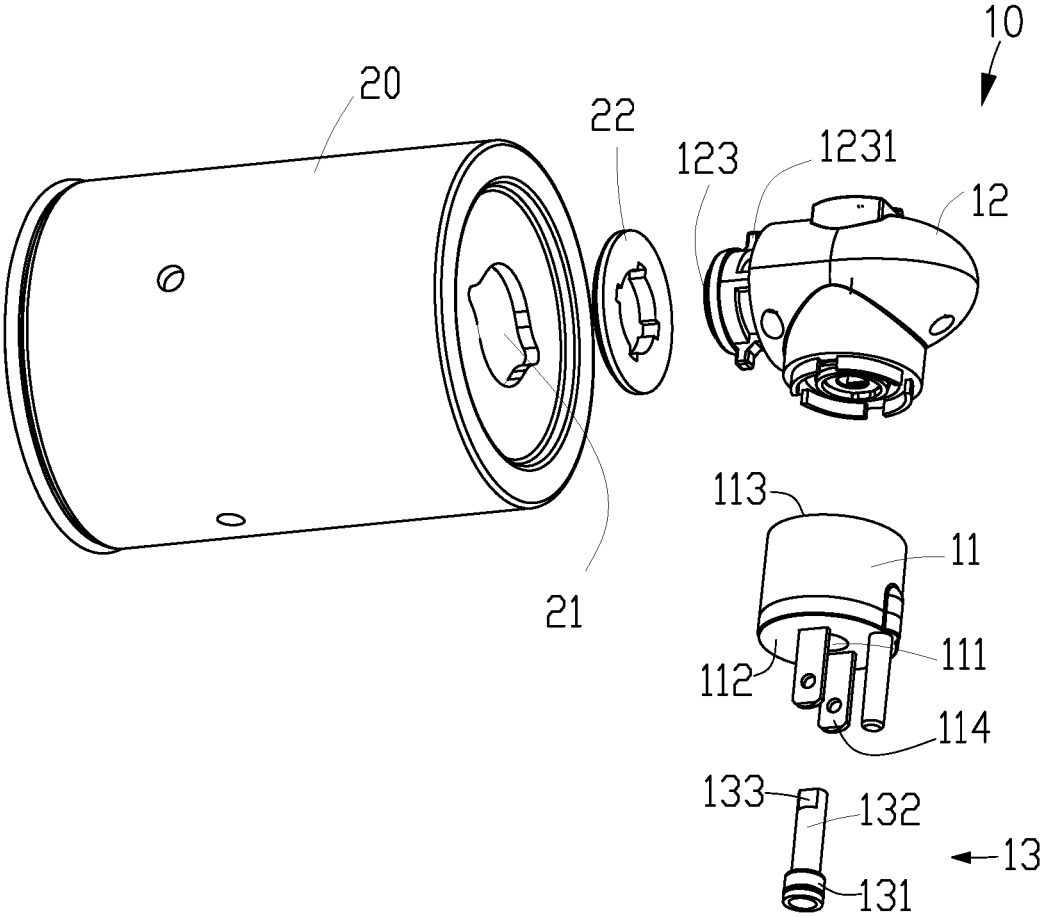
FIG. 1 is an exploded view of a night light in accordance with an embodiment of the present invention.
Figure 2:
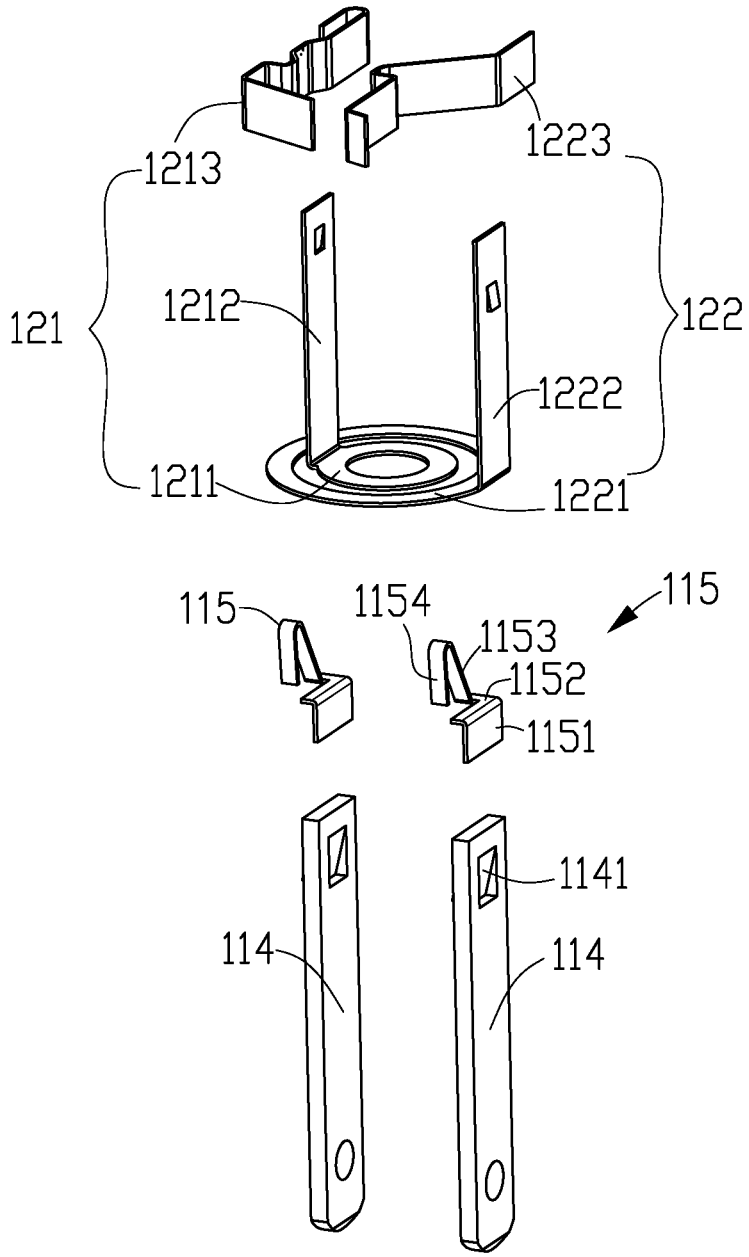
FIG. 2 is an exploded view of an electrical assembly of the night light in FIG. 1.

The invention will now be described in detail through several embodiments with reference to the accompanying drawings.

Please refer to FIG. 1 to FIG. 7, a small night light in accordance with an embodiment of the present invention mainly includes a rotatable electrical connector 10 and a light head 20 removably connected to the rotatable electrical connector 10. The rotatable electrical connector 10 mainly includes a fixed part 11, a rotatable part 12, and a shaft 13. For the convenience of description, an end with pins 114 of the rotatable electrical connector 10 is located at a lower side and defined as an lower end, and the other end connected to the light head 20 is located at an upper side and defined as an upper end.

The rotatable part 12 can rotate relative to the fixed part 11 around the shaft 13. In detail, the shaft 13 includes a round head 131 and a straight shank 132. The free end of the shank 132 has a cut-out part 133 used as a limit part. The fixed part 11 define a through hole 111 running through both ends (a lower end 112 and an upper end 113) and allowing the shank 132 to pass through The shank 132 of the shaft 13 inserts into the through hole 111 with its free end protrudes out of the through hole 111. The free end of the shank 132 is fixedly connected to the rotatable part 12. The shaft 13 can't rotate relative to the rotatable part 12, but can rotate relative to the fixed part 11.

In the embodiment, the fixed part 11 is provided with the two pins 114 used for electrically connecting with an external power socket. Two elastic elements 115 are fixed to top ends of the two pins 114, respectively. The elastic elements 115 are used for providing upward elastic support to upper electrical members 121, 122 of the rotatable part 12. That is, the elastic elements 115 are used to constantly contact and press the upper electrical members 121, 122 of the rotatable part 12.

Figure 3:
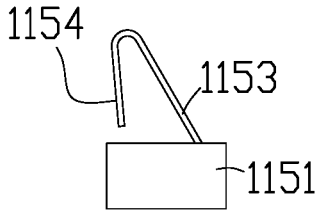
FIG. 3 is a front view of an elastic element of the electrical assembly in FIG. 2.
Figure 4:
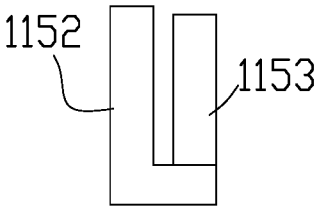
FIG. 4 is a top view of the elastic element in FIG. 3.
Figure 5:
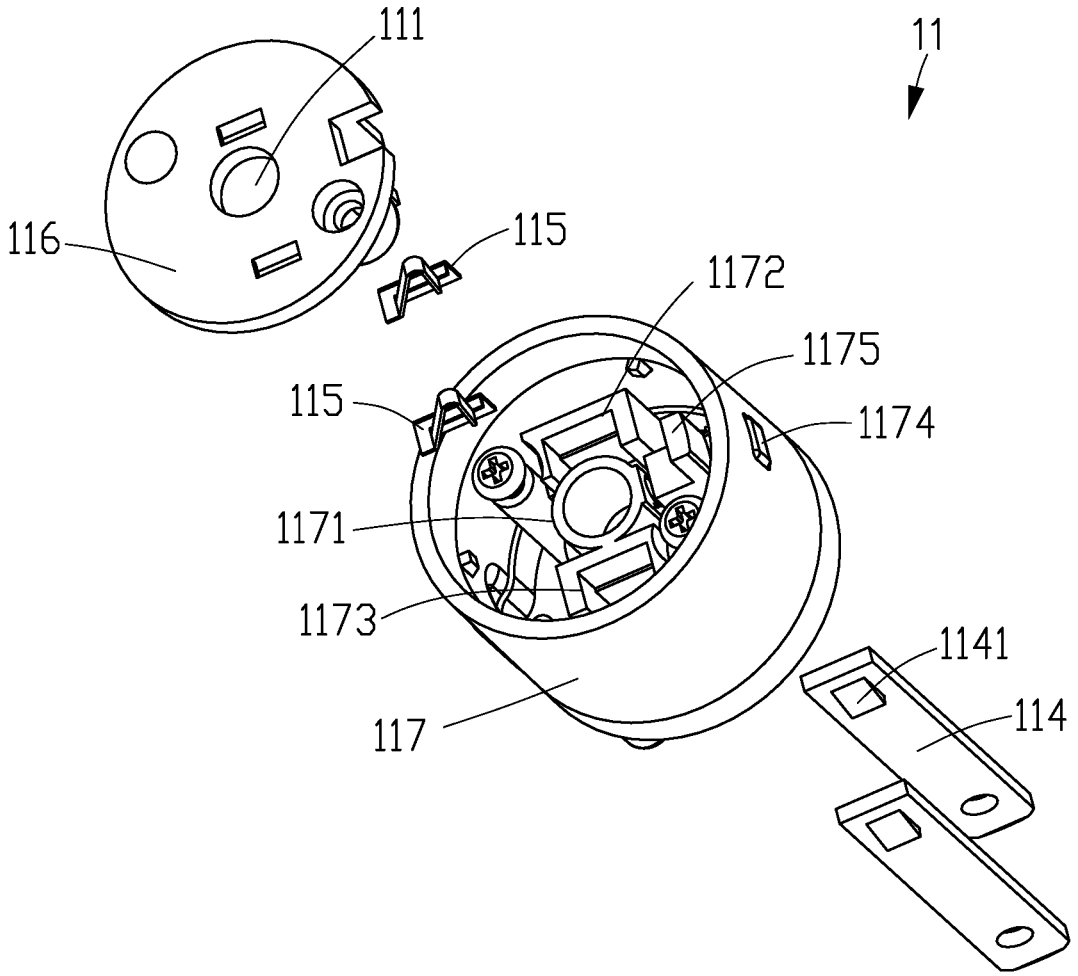
FIG. 5 is an exploded view of a fixed part of the night light in FIG. 1.
Figure 6:
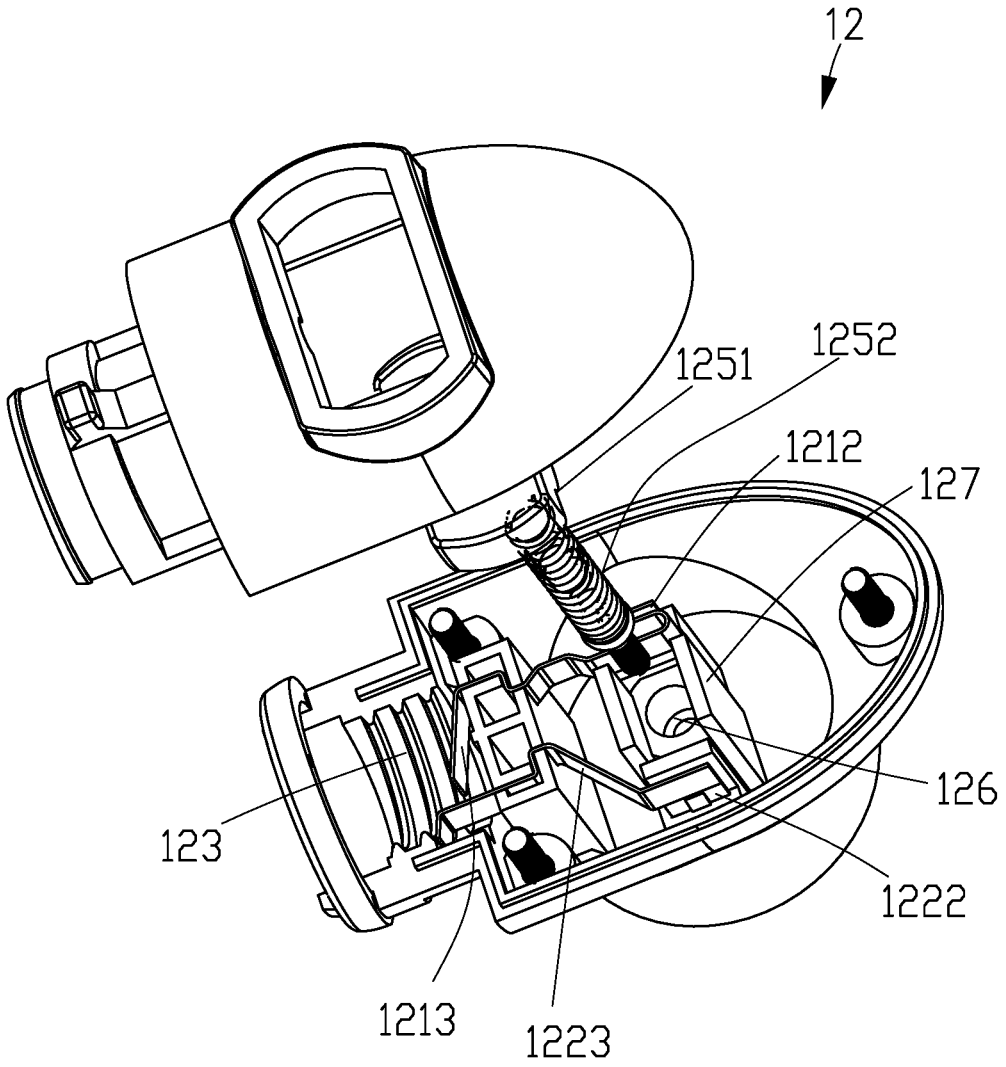
FIG. 6 is an exploded view of a rotatable part of the night light in FIG. 1.
Figure 7:
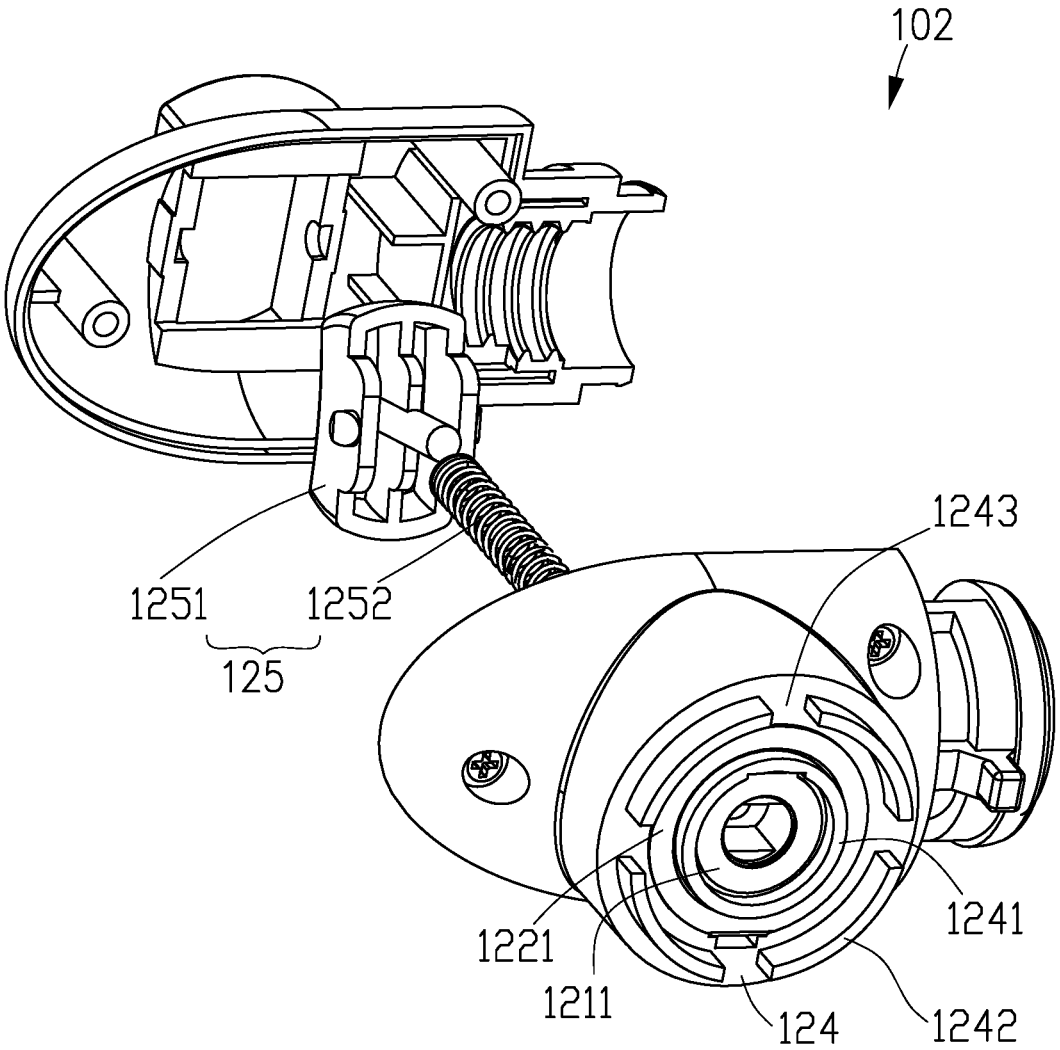
FIG. 7 is another exploded view of a rotatable part of the night light in FIG. 1.

In the embodiment, the elastic elements 115 have the same structure, both made of conductive metal sheet. Each elastic element 115 has a first plate 1151, a second plate 1152 extending substantially perpendicularly from the first plate 1151, a third plate 1153 extending obliquely toward the upper electrical member 121 or 122 from the second plate 1152, and a fourth plate 1154 extending obliquely or perpendicularly toward the second plate 1152 from an end of the third plate 1153. The projections of the second plate to the fourth plate 1152-1154 on a plane where the first plate 1151 is located substantially form a triangle. The projections of the third plate 1153 and the fourth plate 1154 only connected at the joint between the two on a plane where the second plate 1152 is located, or overlap partially. In the embodiment, the fourth plate 1154 extends obliquely toward the second plate 1152, and the projections of the third plate 1153 and the fourth plate 1154 overlap partially, as shown in FIG. 3 and FIG. 4. It is understood that the elastic element 115 is formed by integrally bending one piece of metal sheet.

The first plate 1151 is fixed to a side surface of the pin 114, the second plate 1152 is fixed to a top surface of the pin 114. At least a part of the third plate 1153 and the fourth plate 1154 of the elastic elements 115 is exposed from an upper end of the fixed part 11.

In the embodiment, the fixed part 11 includes a barrel 117 and a cover plate 116 covering the barrel 117. The barrel 117 includes three hollow posts 1171, 1172, 1173 for securely mounting the shaft 13 and the pins 114, respectively. The pins 114 are inserted into the hollow posts 1172, 1173 from upper ends of the hollow posts 1172, 1173, the elastic elements 115 and upper ends of the pins 114 are kept on the upper ends of the hollow posts 1172, 1173. The upper ends of the elastic elements 115 are exposed from holes defined on the cover plate 116, and abut against the upper electrical members 121, 122 of the rotatable part 12. For ease of assembly, a clamping groove for clamping and fixing is provided on the upper ends of the hollow posts 1172, 1173, and a clamping convex hook 1141 matching the clamping groove is provided on the upper ends of the pins 114. The convex hook 1141 is used to cooperate with the clamping groove to facilitate the quick assembly of the pin 114 in place, and effectively prevent the pin 114 from falling off the fixing portion 11.

The upper electrical members 121, 122 includes two concentric annular conductive members 1211, 1221, two conductive sheets 1212, 1222 extend perpendicularly from the two concentric annular conductive members 1211, 1221 respectively, and two elastic elements 1213, 1223. The rotatable part 12 is further provided with a connecting seat 123 for installing the light head 20, a switch assembly 125. The two elastic elements 1213, 1223 contact and electrically connect with the light head 20. The elastic element 1223 is fixed to and electrically connected to free end of the conductive sheet 1222, while the elastic element 1213 is not fixed to and electrically connected to free end of the conductive sheet 1212 when the switch assembly 125 of the night light is off. The elastic element 1213 is pressed to contact with and electrically connects to free end of the conductive sheet 1212 when the switch assembly 125 of the night light is on. During use, the two elastic elements 115 and the two concentric annular conductive members 1211, 1221 always contact respectively. Lateral force generated on the elastic elements 115 during relative rotation causes the elastic elements 115 to deform but remain contact with the upper electrical members, and when the force is eliminated, the elastic elements 115 restores, thereby ensuring the reliability of the night light during use.

In an embodiment, the bottom 124 of the rotatable part 12 is provided with an annular protrusion 1241. The annular protrusion 1241 abuts against the cover plate 116, thereby forming two receiving grooves besides the annular protrusion 1241 and isolated from each other. The two annular conductive members 1211, 1221 are respectively located in the two receiving grooves, which effectively realizes the relative insulation between the two annular conductive members 1211, 1221 and avoids short circuit. The ring-shaped protrusion 1241 is used to make the receiving grooves have a certain height/depth, so that a space is reserved for the deformation and recovery of the elastic elements 115 in the receiving groove, and the effectiveness of the elastic elements 115 and the annular conductive members 1211, 1221 in contact and conduction is ensured.

In the embodiment, the bottom of the rotatable part 12 is provided with several arc-shaped protrusions 1242. The arc-shaped protrusions 1242 are evenly distributed with notches 1243 therebetween, and the fixed part 11 is provided with a button 1174 connecting to a control part 1175 to control a rotation angle of the rotatable part 12. When the button 1174 is in its original position, the control part 1175 is located and locked in one of the notches 1243, and the rotatable part 12 can not rotate. When the button 1174 is pressed, the control part 1175 is moved out of the notche 1243, and the rotatable part 12 can rotate.

When rotating the rotatable part 12, firstly press the button 1174 to disengage the control part 1175 out of the current notch 1243, then rotate the rotatable part 12 until the control part 1175 engages in the next notch 1243, thereby realizing the locking of the rotatable part 12.

In one embodiment, the switch assembly 125 includes a switch button 1251 disposed on the top of the rotatable part 12 and a spring 1252 connected to a post formed on the bottom of the switch button 1251. As described above, the elastic element 1213 is not fixed to and electrically connected to free end of the conductive sheet 1212 when the switch assembly 125 of the night light is off. There is a gap between the elastic element 1213 and the free end of the conductive sheet 1212. When the switch button 1251 is pressed to turn on the night light, the post presses the elastic element 1213 to contact with and electrically connects to free end of the conductive sheet 1212.

The rotatable part 12 is further provided with a limit post 126 defining a through hole for receiving the spring 1252, so that a deformation direction of the spring 1252 is limited. Two limit plates 127 are also provided in the rotatable part 12. The limit plates 127 are located on opposite sides of the limit post 126 and form a limit channel for the switch button 1251. The limit channel is used to ensure the control stability of the switch button 1251.

In the embodiment, the light head 20 is mainly a lamp shade used for effectively preventing a lamp from being damaged and prolonging the service life of the product. Specifically, the outer wall of the connecting seat 123 is provided with a mounting snap ring 1231, the light head 20 is provided with a mounting hole 21 corresponding to the mounting snap ring 1231. The light head 20 connects to the rotatable part 12 by the rotation fit between the mounting hole 21 and the mounting snap ring 1231. For quick installation, during operation, first align the mounting hole 21 with the mounting snap ring 29 and push in, and then rotate the light head 20 to make the mounting hole 21 and the mounting snap ring 29 misaligned, so that the light head 20 is clamped.

In the embodiment, the small night light may further includes a silicone pad 22 arranged between the light head 20 and the rotatable part 12. The silicone pad 22 is used to avoid hard contact between the light head 20 and the rotatable part 12 and damage the light head 20. At the same time, the friction force of the silicone pad 22 on the light head 20 is used to effectively prevent the light head 20 from loosening, and to ensure the stability of the light head 20 installed on the rotatable part 12.

In summary, the small night light of the present invention realizes the rotatable function through the fixed part 11 and the rotatable part 12 rotatably arranged on the fixed part 11, wherein the pins 114 of the fixed part 11 realize elastic contact with the upper electrical members of the rotatable part 12 through the elastic elements 115, effectively ensure the stability of contact and conduction between the pins and the upper electrical members, and improve the reliability of the night light during use.

Understandably, the rotatable electrical connector 10 may be sold as a single product. The light head 20 may be replaced by other small electrical equipment, such as aroma diffusers.

While the invention has been described in terms of several exemplary embodiments, those skilled on the art will recognize that the invention can be practiced with modification within the spirit and scope of the appended claims. In addition, it is noted that, the Applicant's intent is to encompass equivalents of all claim elements, even if amended later during prosecution.

What is claimed is:

1. A rotatable electrical connector, comprising:

a fixed part, comprising:

two pins configured for electrically connecting with an external power socket; and two elastic elements fixed to top ends of the two pins, respectively;

a rotatable part comprising two concentric annular conductive members exposed at a lower end of the rotatable part; and a shaft connecting the rotatable part and the fixed part and allowing the rotatable part to rotate relative to the fixed part;

wherein the two elastic elements provide upward elastic support to the two concentric annular conductive members, respectively, such that the elastic elements can constantly contact and press the two concentric annular conductive members when the rotatable part rotates relative to the fixed part.

2. The rotatable electrical connector according to claim 1, wherein each elastic element comprises:

a first plate;

a second plate extending substantially perpendicularly from the first plate;

a third plate extending obliquely toward one of the two concentric annular conductive members from the second plate; and a fourth plate extending obliquely or perpendicularly toward the second plate from an end of the third plate.

3. The rotatable electrical connector according to claim 2, wherein projections of the second plate, the third plate and the fourth plate on a plane where the first plate is located substantially form a triangle.

4. The rotatable electrical connector according to claim 3, wherein the first plate is fixed to a side surface of one of the two pins, the second plate is fixed to a top surface of the pin; at least a part of the third plate and the fourth plate of the elastic elements is exposed from an upper end of the fixed part.

5. The rotatable electrical connector according to claim 4, wherein a bottom of the rotatable part is provided with an annular protrusion abutting against the fixed part, thereby forming two receiving grooves besides the annular protrusion, the two annular conductive sheets are respectively located in the two receiving grooves.

6. The rotatable electrical connector according to claim 5, wherein the bottom of the rotatable part is further provided with a plurality of arc-shaped protrusions, the arc-shaped protrusions are evenly distributed with notches therebetween, and the fixed part further comprises a button connecting to a control part configured for controlling a rotation angle of the rotatable part; when the button is in its original position, the control part is located and locked in one of the notches, and the rotatable part can not rotate; when the button is pressed, the control part is moved out of the notche, and the rotatable part can rotate.

7. The rotatable electrical connector according to claim 5, wherein the rotatable part is further provided with a switch assembly, two conductive sheets extending perpendicularly from the two concentric annular conductive sheets respectively, and two elastic members; one of the two elastic members is fixed to and electrically connected to free end of one of the two conductive sheets, while the other of the two elastic members is not fixed to and electrically connected to free end of the other of the two conductive sheets when the switch assembly is off; the other elastic member is pressed by the switch assembly to contact with and electrically connects to free end of the other conductive sheet when the switch assembly is turned on.

8. A night light using the rotatable electrical connector according to claim 1, comprising;

the rotatable electrical connector; and a light head removably connected to the rotatable electrical connector.

9. The night light according to claim 8, wherein each elastic element comprises:

a first plate;

a second plate extending substantially perpendicularly from the first plate;

a third plate extending obliquely toward one of the two concentric annular conductive members from the second plate; and a fourth plate extending obliquely or perpendicularly toward the second plate from an end of the third plate.

10. The night light according to claim 9, wherein projections of the second plate, the third plate and the fourth plate on a plane where the first plate is located substantially form a triangle.

11. The night light according to claim 10, wherein the first plate is fixed to a side surface of one of the two pins, the second plate is fixed to a top surface of the pin; at least a part of the third plate and the fourth plate of the elastic elements is exposed from an upper end of the fixed part.

12. The night light according to claim 11, wherein a bottom of the rotatable part is provided with an annular protrusion abutting against the fixed part, thereby forming two receiving grooves besides the annular protrusion, the two annular conductive sheets are respectively located in the two receiving grooves.

13. The night light according to claim 12, wherein the bottom of the rotatable part is further provided with a plurality of arc-shaped protrusions, the arc-shaped protrusions are evenly distributed with notches therebetween, and the fixed part further comprises a button connecting to a control part configured for controlling a rotation angle of the rotatable part; when the button is in its original position, the control part is located and locked in one of the notches, and the rotatable part can not rotate; when the button is pressed, the control part is moved out of the notche, and the rotatable part can rotate.

14. The night light according to claim 13, wherein the rotatable part is further provided with a switch assembly, two conductive sheets extending perpendicularly from the two concentric annular conductive sheets respectively, and two elastic members; one of the two elastic members is fixed to and electrically connected to free end of one of the two conductive sheets, while the other of the two elastic members is not fixed to and electrically connected to free end of the other of the two conductive sheets when the switch assembly is off; the other elastic member is pressed by the switch assembly to contact with and electrically connects to free end of the other conductive sheet when the switch assembly is turned on.

* * * * *